US006805204B2

(12) United States Patent
Bauer et al.

(10) Patent No.: US 6,805,204 B2
(45) Date of Patent: Oct. 19, 2004

(54) VEHICLE, ESPECIALLY FOR BEACH CLEANING

(75) Inventors: Christian Bauer, Neu-Ulm (DE); Hendrik Grobler, Lauingen (DE)

(73) Assignee: Kaessbohrer Gelaendefahrzeug AG, Senden (DE)

( * ) Notice: Subject to any disclaimer, the term of this patent is extended or adjusted under 35 U.S.C. 154(b) by 0 days.

(21) Appl. No.: 10/100,574

(22) Filed: Mar. 18, 2002

(65) Prior Publication Data

US 2002/0170765 A1 Nov. 21, 2002

(30) Foreign Application Priority Data

Mar. 16, 2001 (DE) ..... 101 13 702

(51) Int. Cl.[7] ..... A01D 17/00
(52) U.S. Cl. ..... 171/111; 111/143; 404/124
(58) Field of Search ..... 171/45, 46, 111, 171/112, 124, 125, 144, 140, 143; 180/234, 235, 242; 404/122, 124, 128, 133.2

(56) References Cited

U.S. PATENT DOCUMENTS

| | | | | | |
|---|---|---|---|---|---|
| 3,937,292 | A | * | 2/1976 | Kincaid, Jr. | 180/238 |
| 4,378,052 | A | * | 3/1983 | Anderson | 172/449 |
| 4,662,472 | A | * | 5/1987 | Christianson et al. | 180/235 |
| 4,735,547 | A | * | 4/1988 | Wagner et al. | 414/686 |
| 5,147,003 | A | * | 9/1992 | De Monclin | 180/14.2 |
| 5,197,211 | A | | 3/1993 | Haug | 37/8 |
| 5,220,965 | A | | 6/1993 | Haug | 171/116 |
| 5,295,318 | A | * | 3/1994 | Schaeff | 37/379 |
| 5,404,613 | A | | 4/1995 | Whyte | |
| 5,586,031 | A | | 12/1996 | Fuessl | |
| 5,896,929 | A | * | 4/1999 | Dori | 172/1 |
| 5,899,292 | A | * | 5/1999 | Paul et al. | 180/419 |
| 6,094,847 | A | * | 8/2000 | Gallenberg | 37/422 |
| 6,253,691 | B1 | * | 7/2001 | McQuinn | 111/118 |
| 6,449,934 | B1 | * | 9/2002 | Reimers et al. | 56/14.7 |

FOREIGN PATENT DOCUMENTS

| | | | |
|---|---|---|---|
| DE | 2 109 372 | 9/1972 | |
| DE | 2 127 410 | 12/1972 | |
| DE | 2541 108 C2 | 2/1987 | E01H/1/08 |
| DE | 3517 079 C2 | 7/1988 | E01H/1/08 |
| DE | 3903 400 A1 | 8/1990 | B62D/12/00 |
| DE | 4336 821 A1 | 5/1995 | A01D/34/43 |
| DE | 44 16 790 | 6/1995 | |
| EP | 0 347 362 | 12/1989 | |
| EP | 0387 794 | 9/1990 | |
| EP | 0 486 053 A1 | 5/1992 | |
| FR | 2 687 533 | 8/1993 | |

* cited by examiner

*Primary Examiner*—Robert E Pezzuto
*Assistant Examiner*—Nathan Mammen
(74) *Attorney, Agent, or Firm*—Greenberg Traurig

(57) ABSTRACT

A vehicle, especially for beach cleaning, with a vehicle frame on which a front wheel axle and a rear wheel axle are arranged, is known in the art. According to the invention, the vehicle frame is divided into a front section and a rear section, which are connected to one another by an articulated bearing with a vertical steering type axle.

22 Claims, 5 Drawing Sheets

VEHICLE, ESPECIALLY FOR BEACH CLEANING

BACKGROUND OF THE INVENTION

The invention relates to a vehicle, especially for beach cleaning, with a vehicle frame on which a front wheel axle and a rear wheel axle are arranged.

BACKGROUND ART

Such a vehicle is disclosed in EP 0 387 794 B1. The vehicle is used for beach cleaning and features a vehicle frame on which a front wheel axle and a rear wheel axle are arranged. The vehicle is propelled by a hydraulic driving mechanism, which acts on at least one of the two axles. The vehicle frame is rigidly designed. A steering mechanism is assigned to the wheels of the front wheel axle.

The object of the invention is to provide a vehicle of the type specified initially, but which exhibits favorable mobility and maneuverability characteristics.

SUMMARY OF THE INVENTION

This object is solved by dividing the chassis into a front section and a rear section, which are connected to one another by an articulated bearing with a vertical steering type axle. In contrast to the state of the art, in the vehicle described by the invention the vehicle frame is not rigid, but is instead designed as an articulated rod frame. As a result, the vehicle exhibits favorable mobility and maneuverability characteristics. In an especially preferred embodiment, the vehicle is used for beach cleaning and features a relatively narrow vehicle width. As a result of the favorable mobility and maneuverability characteristics imparted by the articulated steering mechanism defined by the articulated bearings, the vehicle can also traverse narrow paths which change direction significantly and abruptly, especially between beach chairs on a beach.

In an embodiment of the invention, a steering mechanism is assigned to the rear wheels of the rear wheel axle. This further improves the mobility and maneuverability of the vehicle. The rear wheel steering mechanism is preferably designed as an axle pivot steering mechanism.

In an embodiment of the invention, the front wheels of the front wheel axle are provided with a steering mechanism. As a result, both the front and rear wheels can be steered individually, or only the front wheels can be provided with a steering mechanism.

In a further embodiment of the invention, a hydrostatic all-wheel drive system is provided as the driving mechanism. In this type of driving mechanism, a hydromotor supplied by one or two hydraulic pumps through a hydraulic pumping unit is preferably assigned to each wheel. This, in turn, is driven by a diesel motor.

In a further embodiment of the invention, an electrical all-wheel drive system is proved as the driving mechanism. This is a highly environmentally friendly variant.

In a further embodiment of the invention, a hybrid all-wheel drive system in the form of a diesel-electric drive is provided as the driving mechanism. In this case, the diesel motor can serve as the generator for the electric drives, which are allocated to each wheel.

In a further embodiment of the invention, an internal combustion engine for the vehicle's driving mechanism is arranged in the front section of the vehicle frame, with a power takeoff arranged in the front of the vehicle connected to it. An attachment device for additional equipment, which can be operated by the power takeoff, is preferably provided in the front section of the vehicle. Various devices can be provided as additional equipment, such as those that have already been proposed for the front section of the vehicle in EP 0 387 794 B1. Depending on the application, other appropriately modified pieces of additional equipment can be provided.

In a further embodiment of the invention, which is provided with a leveling device in the rear section of the vehicle, it is provided that the leveling device pivots between an operating position in which it is lowered to the ground and a resting position. This embodiment is especially advantageous if the vehicle is used for beach cleaning, as the ground can be provided with a smooth surface by the leveling device after it has been traversed by the cleaning unit.

In a further embodiment of the invention, the leveling or smoothing device is designed as a rotating roller, which is provided with a barrel profile that presses a specific pattern into the ground. This type of pattern can be used for advertising purposes. The ground can also be provided with a uniformly shaped surface which is aesthetically pleasing.

In a further embodiment of the invention, in which a collection container for collected material is provided, a floor section of the collection container runs on moveable bearings between a closed operating position and an emptying position that exposes the interior of the container. This enables the collection container to be emptied without the need to tilt it. The collection container is preferably linked to the chassis with the aid of support arms or another form of mounting mechanism, or is permanently or detachably connected to it by some other means.

In a further embodiment of the invention, in which the collection container is mounted onto the rear section on pivoting or tilting bearings, the rear section features a horizontally spatially displaceable auxiliary frame to which the collection container is linked, and which is especially provided with a platform. Because of the spatial displacement, preferably in the vehicle's longitudinal direction and in the vehicle's vertical direction, it is possible to empty the collection container. If the auxiliary frame is provided with a platform, the spatial displacement in a horizontal direction advantageously enables this platform to be used as a loading surface, as the platform remains horizontally aligned even when displaced in space, i.e., when moved up, down, forward, or backward.

In a further embodiment of the invention, at least one driving mechanism is provided for spatial displacement of the auxiliary frame. At least one hydraulic control unit in the form of at least one hydraulic cylinder is especially provided as the driving mechanism.

In a further embodiment of the invention, parallel articulated mechanisms are provided for spatial displacement of the auxiliary frame, which are actively connected to an automatic guiding mechanism linked to the collection container, so that the collection container is automatically brought into its emptying position when the auxiliary frame is moved upward and backward (relative to the normal direction of travel), and is brought into a collecting position when the auxiliary frame is moved into its lowered position. This embodiment eliminates the need for an additional driving or control mechanism for tilting or pivoting the collection container, as the automatic guiding mechanism itself derives the respective tilting or pivoting motion from the spatial displacement motion of the auxiliary frame. The parallel articulated mechanisms represent an especially simple and functionally reliable form of spatial displacement of the auxiliary frame in horizontal alignment.

In a further embodiment of the invention, which includes a cleaning device for loose ground arranged on a support frame mounted on pivoting bearings between a receiving position lowered toward the ground and a resting position pivoted upward, wherein the cleaning device features a filter device with a circumferential filter belt, it is provided that a carrying run of the filter belt is mounted on vibrating rollers running on eccentric bearings, which rollers are offset against one another. As a result, the carrying run forms a vibrating surface to separate the sand from other material, especially stones or garbage. Preferably, driving mechanisms are provided for the vibrating rollers that ensure a defined phase shift which remains uniform for the duration of operation.

In a further embodiment of the invention, which includes a cleaning device for loose ground arranged on a support frame mounted on pivoting bearings between a receiving position lowered toward the ground and a resting position pivoted upward, wherein the cleaning device features a filter device with a circumferential filter belt, it is provided that the filter belt is assigned at least one vibration shaft on which at least one vibration element is arranged coaxially and which is connected to the filter belt and which—when seen in cross-section—is provided with greater longitudinal than latitudinal extension. The vibration element is preferably designed as a rotationally fixed disk connected to the vibration shaft, with the shape of the disk being preferably elliptical or polygonal. If several vibration shafts arranged in sequence are provided, the vibration elements can preferably be offset in relation to one another. The vibration elements are coaxially threaded onto the respective vibration shafts, arranged in rows, or applied in some other fashion. For each element, this results in two long, radially extending areas arranged in mirror symmetry to its center of gravity, and two short areas, which preferably extend radially and at right angles hereto. This ensures that each vibration element raises the adjacent filter belt two times for each full rotation, thus creating a double lift function. This results in favorable filter performance.

In a further embodiment of the invention, an outside perimeter of the vibration element is provided with a circumferential toothed contour. If the filter belt is advantageously provided as a chain-link belt, the rotationally fixed vibration elements attached to the vibration shafts can serve directly as driving mechanisms for the filter belt, thus eliminating the need for separate driving mechanisms, especially v-belts. As the centers of gravity of the vibration elements are coaxially aligned to the vibration shaft, a mechanical balance is provided that prevents vibrations from being transferred to the support frame.

In a further embodiment of the invention, an independently driven supplementary propulsion mechanism is assigned to the carrying run of the filter belt, which operates together with the carrying run in synchronization with the belt speed of the filter belt. Thus, when the filter belt is at an angle during operation, larger objects or larger material is prevented from falling downward against the direction of operation of the filter belt. This substantially increases cleaning action, as a suitably large object is only transported upward along the filter belt once, without falling back down and having to be transported upward again. The collection container, in which the garbage and other objects are collected and disposed of at the appropriate time, is allocated to the upper end section of the filter belt. In particular, an ascending conveyor equipped with brushes or flexible plates can be provided as a supplementary conveyance mechanism. The relative speed of the ascending conveyor is less than or equal to the speed of the filter belt. The ascending conveyor acts as a form-fit restraint for the material being conveyed on the diagonally ascending carrying run of the filter belt.

In a further embodiment of the invention, a feed roller is assigned to a front end of the support frame, which is provided with a receiving area, which roller pivots by means of a swivel arm apparatus connected to the support frame in such a way that it can be moved to the front or back of the receiving area relative to the vehicle's longitudinal direction or can be moved approximately up or down relative to the receiving area. The pivoting mechanism of the feed roller is designed in such a way that two pivoting motions overlap one another to achieve the various movements of the feed roller. The first pivoting movement allows the feed roller to move to the front or back of the receiving area. As a result of superimposing of the second pivoting motion, the approximately vertical displacement relative to the receiving area can be achieved. The displacement of the pivoting arm apparatus and the feed roller is preferably achieved with hydraulic control mechanisms.

In a further embodiment of the invention, at least one horizontal loading surface featuring an at least partially removable floor is assigned to the rear section. As a result, the rear section can take on an additional transport function. The removable floor increases the variability of the rear section.

In a further embodiment of the invention, the loading surface is laterally secured with at least one support railing, which runs on bearings between a locking position and a loading position. The support railing is preferably mounted on pivoting bearings between the locking position and the loading position, so as to facilitate loading and unloading of the loading surface in the loading position. In the locked position, the support railing is securely anchored to the rear section.

In a further embodiment of the invention, protective panels mounted on moveable bearings on the rear section are arranged on both sides of the cleaning device.

Additional advantages and features of the invention result from the claims, to the disclosure of which reference is hereby expressly made, as well as from the following description of preferred examples of the invention, which are illustrated in the figures.

DETAILED DESCRIPTION OF THE DRAWINGS

Figure 1:
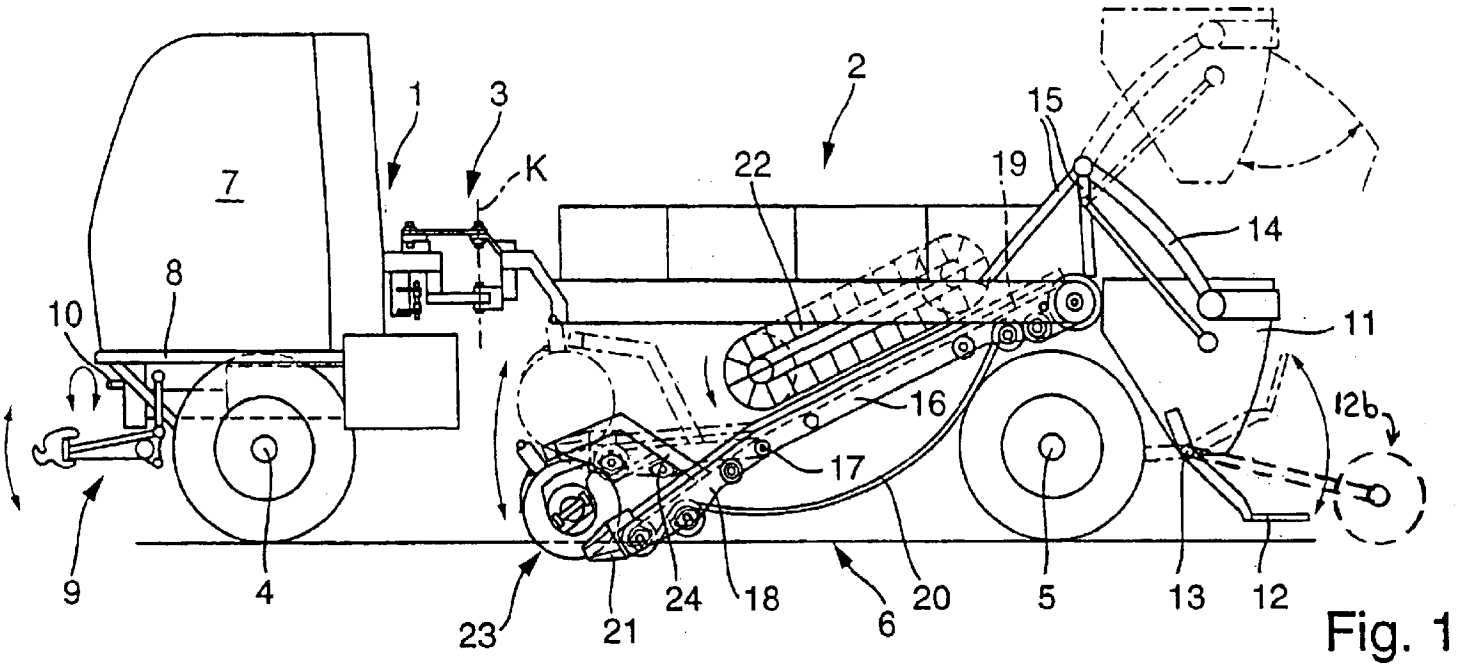
FIG. 1 A lateral view of an embodiment of a beach cleaning vehicle as described by the invention.
Figure 2:
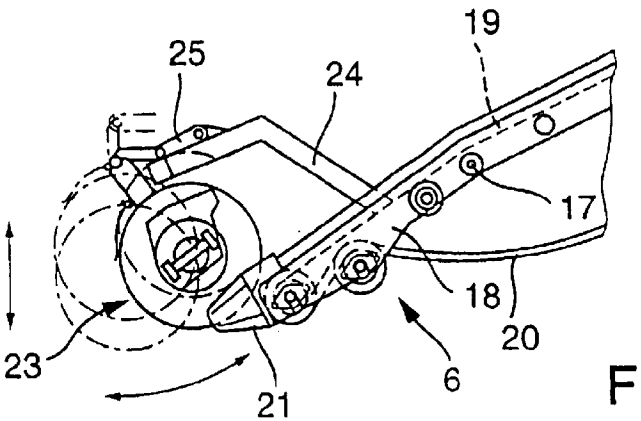
FIG. 2 An enlarged view of a segment of the cleaning device of the beach cleaning vehicle depicted in FIG. 1.
Figure 3:
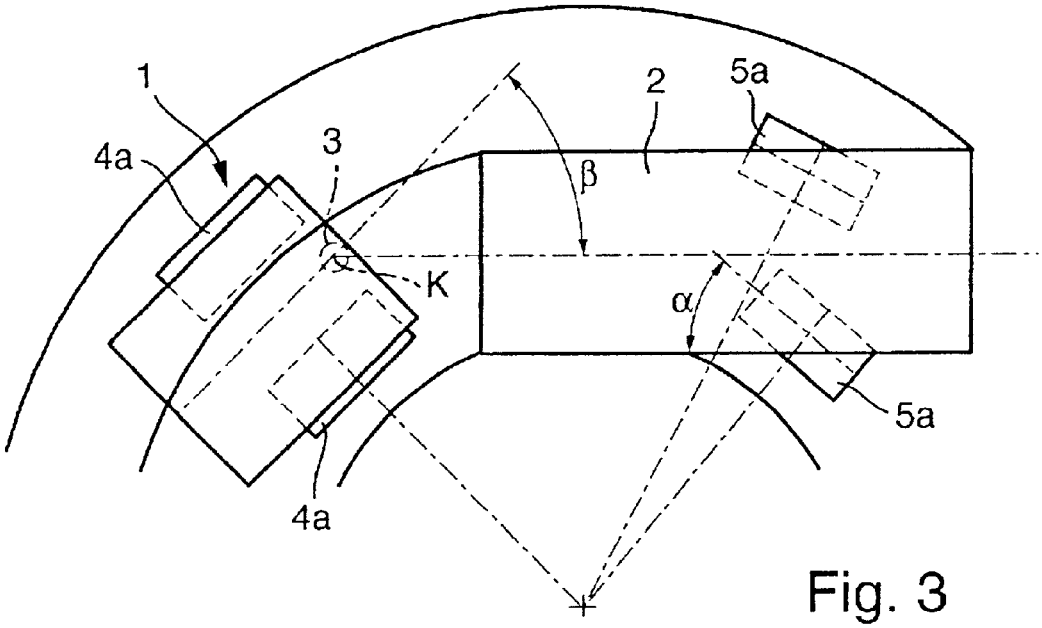
FIG. 3 A schematic aerial view of the beach cleaning vehicle depicted in FIG. 1.

A vehicle as depicted in FIGS. 1 to 3, which is used for beach cleaning, features a central vehicle frame comprising a front section 1 and a rear section 2. The front section 1 and the rear section 2 are connected to one another by an articulated bearing 3 which forms an articulated steering mechanism with a vertical steering type axle K. The articulated bearing 3 is designed so that the front section 1 and the rear section 2 of the vehicle frame pivot horizontally around the articulated axle K relative to one another. The articulated bearing 3 can be designed so that other degrees of freedom are not possible. In this case, the articulated bearing 3 creates a stable support with respect to buckling movements along the horizontal articulated axle or with respect to torsional movements between the front section and the rear section. However, the articulated bearing 3 can also be provided with cushioning or shock-absorbing elements which permit certain compensatory movements with respect to torsional loads or vertical movements, thereby preventing the bearing elements from becoming overloaded, especially when the ground is uneven. It is also possible to devise the articulated bearing 3 as a ball-and-socket joint. Because such a ball-and-socket joint permits movements in various degrees of freedom, all four wheels can remain on the ground even when the vehicle is traversing uneven surfaces, thereby preventing severe stress from being exerted on the articulated bearing. The principal purpose of the articulated bearing 3 is to increase the mobility and maneuverability of the vehicle so that, depending on the mode of application, ball-and-socket or pin-and-bushing couplings can be provided to connect the front section 1 with the rear section 2. In any event, the requirement defined by the invention is that the articulated bearing must feature a vertical steering type axle. However, it is also possible and in many cases advantageous to design the articulated bearing, i.e., the coupling between the front section 1 and the rear section 2, so that that the vertical steering type axle is supplemented by additional, diagonal swiveling axles which pass through a center point shared with the vertical steering type axle, i.e., intersect in a shared center point.

The front section 1 features a front frame section (not described in detail), while the rear section 2 features a rear frame section (also not described in detail). A front wheel axle 4 is arranged on the front frame section, wherein the two front wheels 4*a* can be driven individually in a manner described in detail below. Accordingly, the rear frame section carries two rear wheels 5*a* of a rear wheel axle 5 mounted by means of axle pivot bearings. The upper side of the rear frame section is provided with a loading bridge, which is not described in detail. The loading bridge can take on various functions, such as, and particularly, the transport of auxiliary devices, beach items, or similar articles. The smooth surface of the loading bridge serves as a storage or transport surface for multiple applications, similar to the applications known from snowmobiles.

The rear section is assigned a cleaning device 6, which features a support frame 16 firmly attached to the rear frame section. The support frame 16 extends approximately along the entire width of the vehicle and is arranged at an angle relative to the rear frame section. When viewed from the front, the support frame 16 extends diagonally upward and over the rear wheel axle 5. At approximately the same height as the rear wheel axle 5, the support frame 16 is firmly attached to the rear frame section above the rear wheels 5*a*. The support frame 16 holds the deflection rollers (not described in detail) for a filter belt 19, 20, whose carrying run 19 forms the filtering and conveying surface for the sand being cleaned. The rotating filter belt 19, 20 is driven by a chain drive. The carrying run 19 is assigned vibration rollers (not described in detail), which run on eccentric bearings and are driven by toothed belts. The eccentric bearings of the vibration rollers, which are arranged at spaced intervals relative to the direction of operation of the filter belt 19, are offset in relation to one another, which improves the vibration effect for the filter belt 19. The support frame 16 and the carrying run and bottom run of the filter belt 19, 20 run at a distance above the rear wheels 5*a*, thus enabling them to be moved for steering purposes.

Behind the rear wheel axle, a collection container for the material collected by the filter belt is provided, which is arranged behind the rear deflection roller of the filter belt 19 in such a way that the collected material is conveyed directly from the filter belt 19 to the collection container 11. The collection container 11 can be pivoted between its collecting position and an emptying position indicated by the dot-dashed lines in FIG. 1 by means of swivel arm apparatus 14. According to the dot-dashed lines in FIG. 1, it is evident that the floor and a side wall of the container can be tilted up, so that the collection container 11 opens toward the bottom. This eliminates the need to tilt and empty the collection container 11.

To support the conveyance of the material collected on the carrying run 19 of the filter belt, an ascending conveyor 22 is also assigned to the carrying run 19; it features a rotating conveyor belt equipped with brushes or flexible plates. The conveyor belt progresses in parallel to the carrying run 19 of the filter belt, as is evident in FIG. 1. The ascending conveyor 22 is arranged on the rear frame section or on the support frame 16. The ascending conveyor 22 prevents the material that has been conveyed to the carrying run 19 to fall down again along the diagonal plane of the carrying run 19 when the carrying run 19 is shaken. The conveying speed of the ascending conveyor is less than or equal to the speed of the filter belt.

As the dot-dashed lines in FIG. 1 indicate, another part 18 of the support frame 16 pivots relative to the support frame 16 around a horizontal pivot axis 17, which progresses in the vehicle's latitudinal direction. A hydraulic control mechanism is provided to ensure smooth displacement of the front section 18. The part 18 features a front receiving area which, in the example depicted in the figure, is made up of a collection system 21 or cutter bar. During operation of the cleaning device 6, this collection system 21 is immersed into the ground, i.e., the sand so that, as a result of the forward motion of the vehicle, sand and material to be collected is pushed onto the collection system and, consequently, onto the carrying run 19 of the filter belt. As is evident in FIGS. 1 and 2, the collection system 21 is arranged directly in front of the front deflection roller for the filter belt 19, 20.

The collection and feeding of the sand/dirt mixture to the carrying run 19 of the filter belt is supported by a feed roller 23, which is arranged in front of the collection system 21 and is equipped with flexible tines or brushes. The feed roller 23 is mounted onto a layout frame 24, which is rigidly connected with the front section 18 of the support frame 16. The layout frame 24 is assigned to a swivel arm apparatus 25, by means of which the feed roller 23 can be pivoted, as indicated by the arrows and the dot-dashed lines in FIG. 2, either to the front or back of the collection system 21 or can be height-adjusted vertically by means of a superimposed pivoting motion. The feed roller 23 can be pivoted continuously by means of a control mechanism, preferably hydraulic, which is not depicted in detail in the figure.

At least one vibration roller is arranged on the bottom run 20 [of the filter belt], so that the sand that has fallen through the filter on the carrying run 19 and is caught by the bottom run 20 can also be returned to the ground from the bottom run.

On the front side, a hitch 9 consisting of a front power lift is provided that permits lifting and lowering of a corresponding hitched device according to the dashed double arrow.

The front frame section also carries a driver's cab 7, under which a diesel motor 8 is arranged. The power takeoff 10 is derived from the diesel motor 8 so as to drive corresponding functions of a hitched device as needed. In the example depicted in the figure, a hydraulic motor is assigned to each wheel 4*a*, 5*a*, which results in hydrostatic all-wheel drive. The hydraulic motors are driven by a hydraulic control mechanism, which features one or more hydraulic pumps, which are in turn driven by the diesel motor 8.

As is evident in FIG. 3, the vehicle in the example depicted here is provided with a rear wheel steering mechanism. The steering angle $\alpha$ of the rear wheel steering mechanism is adjusted to correspond to a buckling angle $\beta$ between the front frame section 1 and the rear frame section 2, so that clean steering and driving motion can be achieved. In an example not depicted here, the front wheels are also provided with a steering mechanism, which results in a four-wheel steering system. As a result, steering and driving motion similar to a dog's gait can be achieved.

On the rear side of the vehicle, a smoothing device 12 is provided which consists of a smoothing plate which is pressed to the ground during operation, and which can be tilted upward around a horizontal pivot axis 13 progressing along the latitudinal axis of the vehicle and into the position indicated by the dash-dotted line in FIG. 1. This upward tilting occurs automatically when the vehicle is driven in reverse. The smoothing plate is adjusted with hydraulic control elements. Additional spring elements can be used to achieve adequate pressure against the ground.

In FIGS. 1 to 3, the vehicle is depicted as a self-driving vehicle equipped with its own driving mechanism. However, the cleaning device (6) can also be arranged on a towed vehicle, such as a trailer. This vehicle could then be pulled by an independent towing machine. This vehicle would then represent a towed cleaning device similar to that disclosed in EP 0 488 053 1.

Figure 4:
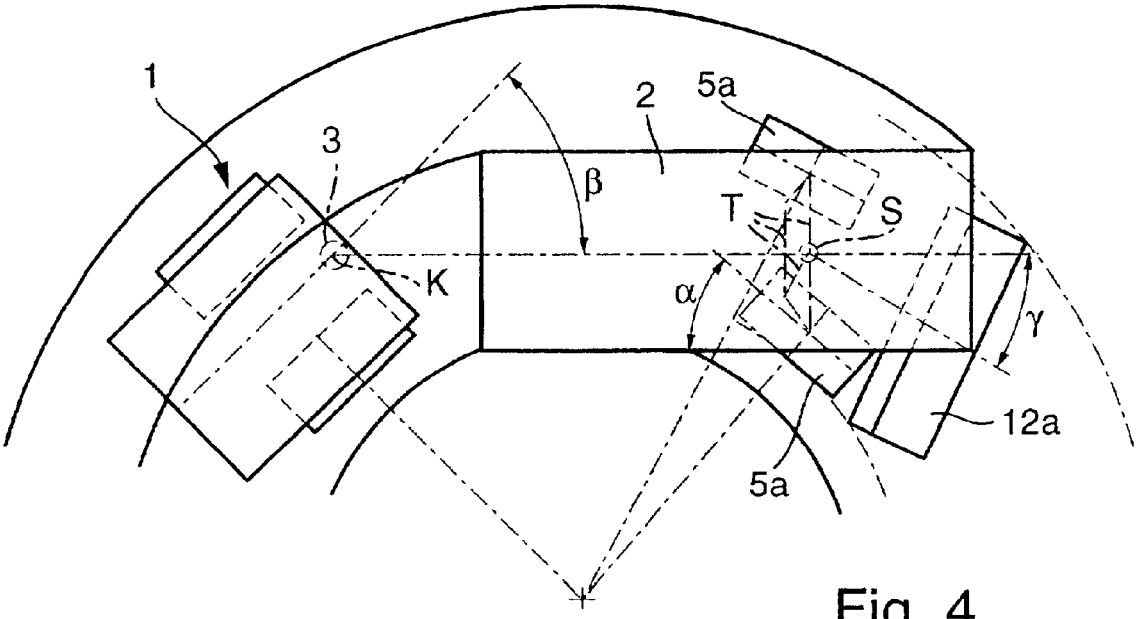
FIG. 4 A schematic aerial view of another beach cleaning vehicle, similar to that depicted in FIG. 3.

As the beach cleaning vehicle depicted in FIG. 4 corresponds to the beach cleaning vehicle described above on the basis of FIGS. 1 to 3, the reader can be referred to the previous description. The only difference is that in the beach cleaning vehicle depicted in FIG. 4, a smoothing device 12*a* is provided which, like the smoothing device 12 depicted in FIG. 1, can be pivoted upward around a horizontal pivot axis or can be lowered. To support this action, a suitable pneumatic or hydraulic cylinder can be provided. In addition, however, the smoothing device 12 pivots horizontally around a vertical pivot axis S, which at least approximately bisects the rear wheel axle of the rear wheel axle pivot steering mechanism. This makes it possible to drag the smoothing device 12*a* in accordance with the steering lock of the rear wheels 5*a*. To this end, the smoothing device 12*a* is linked to the axle pivot steering mechanism of the rear wheels 5*a* through a coupling device T, so that the smoothing device 12*a* pivots around pivot angle $\gamma$ relative to the central longitudinal axis of the vehicle in line with the steering lock of the rear wheels 5*a*. The pivot angle $\gamma$ corresponds approximately to the angle of the various steering angles of the respective outer and respective inner rear wheel 5*a*. In FIG. 4, the steering angle of the inner rear wheel is designed with the symbol $\alpha$. The coupling device T can operate exclusively through mechanical lever rods, through combined mechanical/hydraulic rods, or through exclusively hydraulic coupling elements. In the case of exclusively hydraulic coupling elements, these elements assume the function of both pulling and carrying the smoothing device 12*a*. In the case of a combined mechanical/hydraulic coupling arrangement, suitable hydraulic elements, such as hydraulic cylinders or similar devices, are provided for controlled horizontal pivoting of the smoothing device 12*a*, while the guiding and carrying functions are assumed by mechanical support elements.

The smoothing device 12*a*, which is arranged in the rear section of the vehicle, is linked to the steering kinematics of the rear wheel, i.e., the axle pivot steering mechanism of the rear wheels 5*a*. During steering movements of the rear wheels 5*a*, the smoothing device is automatically guided at an angle corresponding to the angle of lock of the rear wheels 5*a*. As a result, a virtually uniform effective operating width of the smoothing device can be achieved during both straight-line and curve travel. The controlled automatic guidance of the smoothing device 12*a* can be mechanically or hydraulically switched off if necessary. Then the smoothing device 12*a* will only steer itself while following the vehicle, as the smoothing device will then be pulled in a freely pivoting manner around the pivot axis S. In embodiments of the invention, the smoothing device may be configured as a rotating roller 12*b* (as shown in broken lines in FIG. 1), which is provided with a barrel profile that presses a specific pattern into the ground. This type of pattern can be used for advertising purposes. The ground can also be provided with a uniformly shaped surface which is aesthetically pleasing.

A beach cleaning vehicle as depicted in FIGS. 5 to 9 corresponds to the executions described above in terms of all features that are not described in detail below. Consequently, for a more detailed explanation of the beach cleaning vehicle as depicted in FIGS. 5 to 9, the reader is referred to the description provided above. In the following text, only those features and functions of the beach cleaning vehicle depicted in FIGS. 5 to 9 are described in detail that differ from the features and functions of the executions described above. For illustrative purposes, some identically functioning units or parts of the beach cleaning vehicle depicted in FIGS. 5 to 9 are given the same reference numbers as in the executions described earlier, but with the addition of the letter "a".

Figure 8:
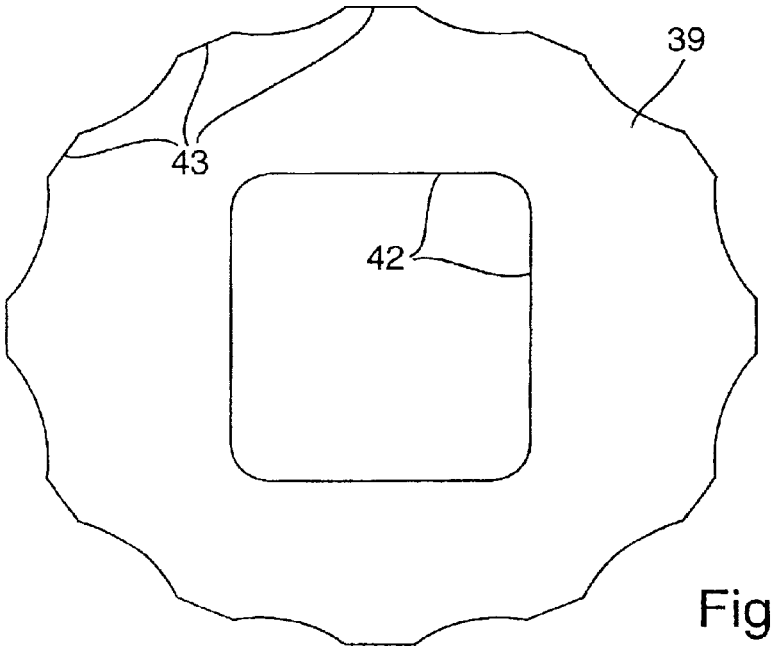
FIG. 8 An additional enlarged view of a rotationally fixed disk connected to the vibration shaft depicted in FIG. 7.

The rear section 2*a* of the beach cleaning vehicle is provided with a cleaning device 6*a* containing a filtering apparatus, the basic structure of which corresponds to the cleaning device described on the basis of FIGS. 1 and 2. The key difference is that in this case a carrying run of the filter belt is supported by several vibration shafts 38 arranged in parallel to one another (FIG. 7), wherein each vibration shaft 38 is provided with several evenly spaced vibration disks 39 that face one another. The vibration disks 39 are coaxially threaded onto a support tube 41 of the vibration shaft 38 at their centers of gravity, wherein spacer sleeves 40 are provided as spacers between the individual vibration disks 39. Each vibration disk is mounted and twist-locked onto an external perimeter of the corresponding square support tube 41 by means of a square hollow section 42. Each vibration disk 39 is essentially elliptical, as indicated in FIG. 8. In the arrangement depicted in the drawing, the vibration disk 39 is wider horizontally than the vertical extent of the vibration disk 39. In addition, the external perimeter of the vibration disk 39 is provided with a toothed contour. The filter belt is made up of filter belt parts executed as linked chain elements, so that the filter belt parts form a rotating chain link belt. Such a chain link belt is known in the art. Because of the toothed contour 43, the individual tooth sections engage the chain link-shaped filter belt from below and exert a conveying motion on the filter belt in its direction of rotation as a result of positive engagement and frictional connection. This eliminates the need for an additional drive for the filter belt.

In a manner not depicted, adjacent vibration shafts are offset by defined phase shifts through the use of toothed belt drives, which engage the vibration shafts from the exterior side. This allows for a further increase in filtration performance.

Figure 5:
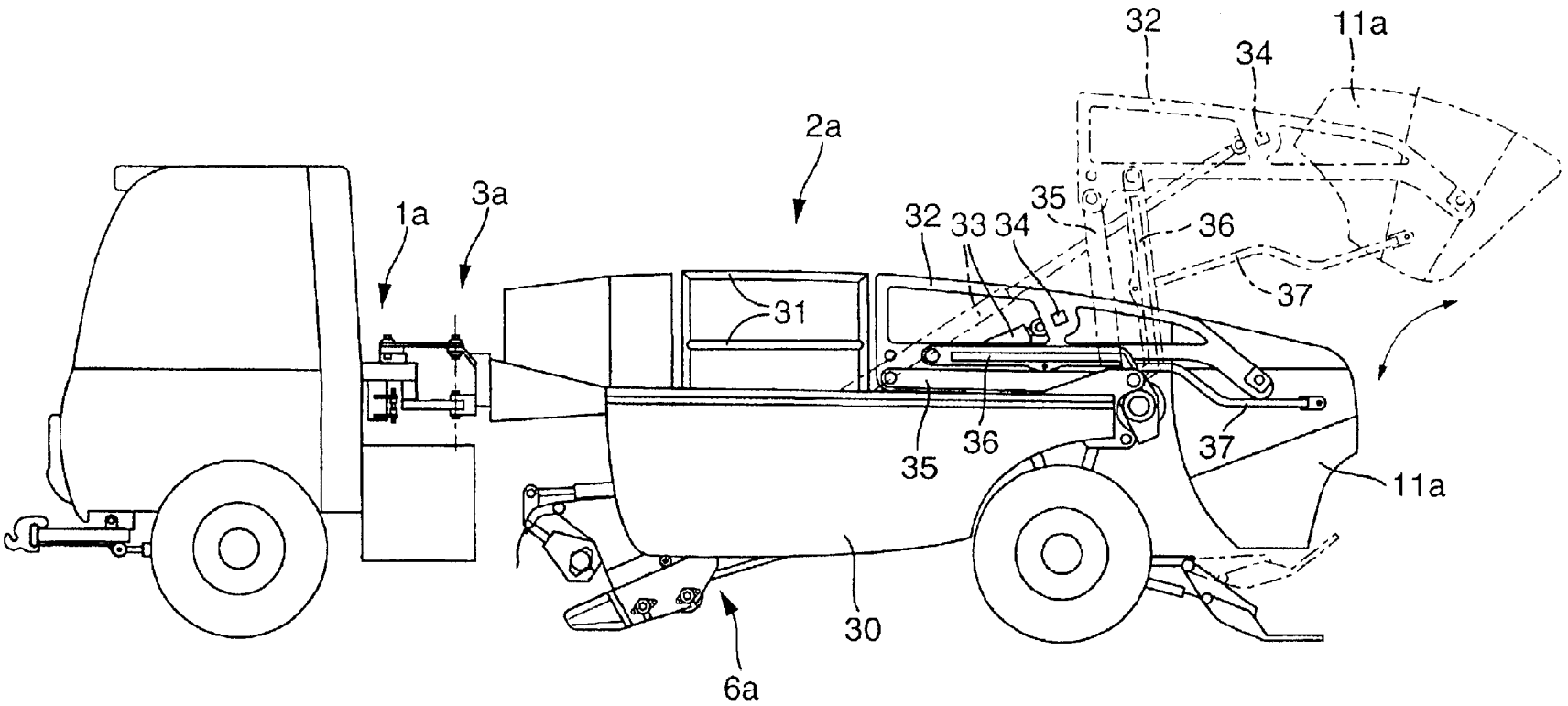
FIG. 5 A lateral view of another embodiment of a beach cleaning vehicle as described by the invention.

On the rear section 2*a*, an auxiliary frame 32 can be displaced horizontally in space between an emptying position, indicated by dashed lines, and a collecting position, indicated by solid lines, by means of a parallel articulated mechanism 35, 36, as shown in FIG. 5. Two parallel levers 35, 36, which are linked to the auxiliary frame 32 on one side and to a main frame of the rear section 2*a* on the other, are provided on each side as parallel articulated mechanisms for parallel displacement of the auxiliary frame 32. An automatic guiding mechanism in the form of a transmission rod 37 is linked to an upper parallel lever 36 and, on its opposite front end, to the collection container 11*a*. To move the auxiliary frame 32 from its collecting position to the emptying position, a pair of synchronously operating hydraulic control cylinders 33 are provided, which are designed as driving mechanisms for spatial displacement of the auxiliary frame 32. The control cylinders 33 engage a horizontal support 34 of the auxiliary frame 32.

The auxiliary frame 32 is provided with a horizontal platform, which is not described in detail in the drawings. It can serve as an additional loading surface. As this additional loading surface remains horizontally aligned during spatial displacement of the auxiliary frame 32, objects being transported are prevented from sliding downward during such spatial displacement.

As is evident in FIG. 5, the automatic guiding mechanism in the form of the transmission rod 37 is linked to the parallel lever 36 on one end and the collection container 11*a* on the other in such a way that when the auxiliary frame 32 is displaced upward and backward, the collection container 11*a* is automatically moved into the tilted emptying position. When the auxiliary frame 32 is lowered again, the transmission rod 37 automatically moves the collection container 11*a* back to the collecting position indicated by the solid lines.

Figure 9:
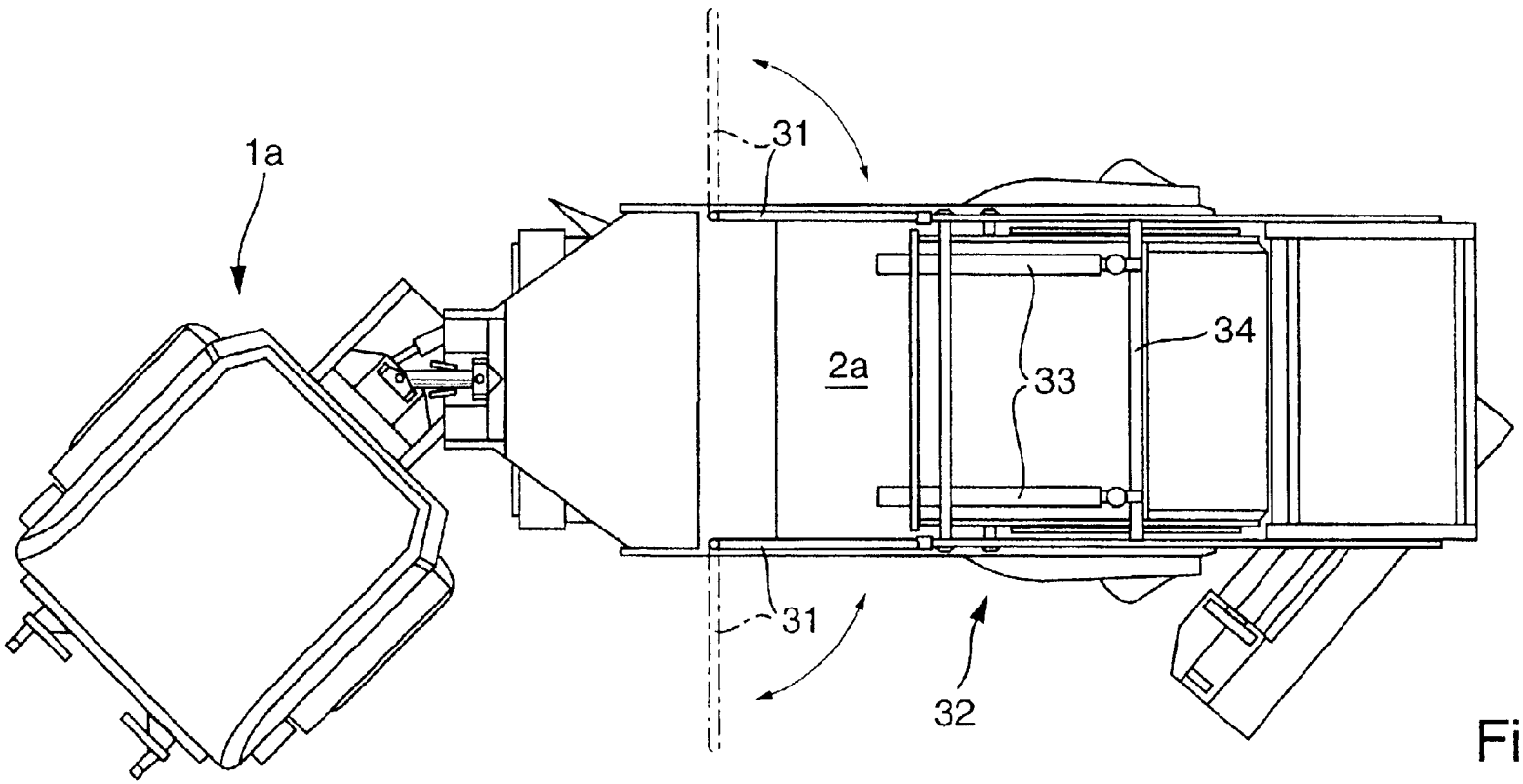
FIG. 9 An aerial view of the beach cleaning vehicle depicted in FIGS. 5 and 6.

As is evident in FIG. 9, the upper side of the rear section is provided with a horizontal loading surface, which is secured on either side by a support railing 31. The support railing 31 on each side pivots around a vertical axis on the rear section 2*a*, thus providing improved access to the loading surface during loading or unloading.

Figure 6:
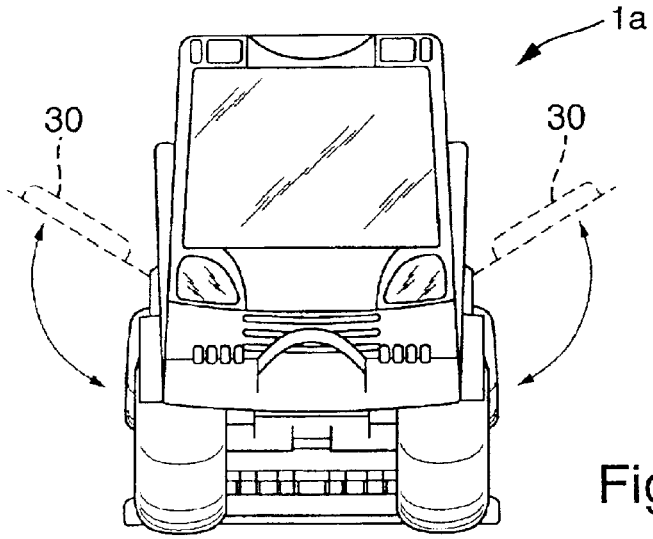
FIG. 6 A frontal view of the beach cleaning vehicle depicted in FIG. 5.
Figure 7:
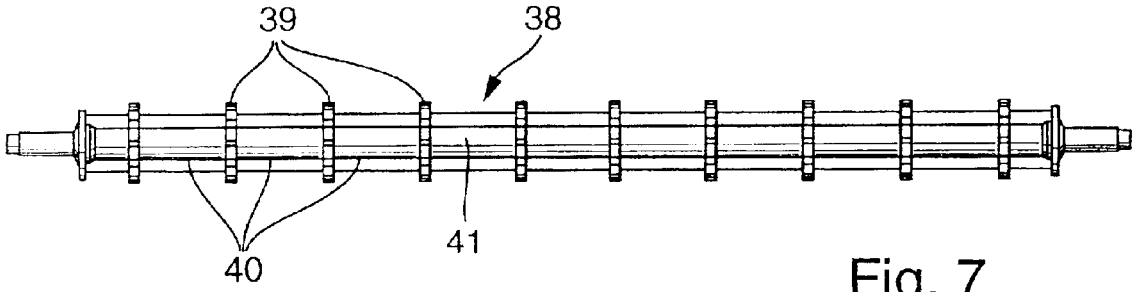
FIG. 7 An enlarged view of a vibration shaft of the filtration device of the beach cleaning vehicle depicted in FIGS. 5 and 6.

As is also evident in FIGS. 5 and 6, for safety reasons the cleaning device 6*a* is closed on either side by a protective screen 30, wherein the protective screens 30, especially for maintenance or repair work, are linked to the rear section 2*a* in such a way as to pivot around horizontal pivot axes, so that they can be tilted up into the open position depicted in FIG. 6 or down into the protected position depicted in FIG. 5.

What is claimed is:

1. A vehicle comprising:

a front section (1,1*a*) of a vehicle frame, including a front wheel axle, a rear section (2,2*a*) of a vehicle frame, including a rear wheel axle, said front section and said rear section being connected to one another by an articulated bearing (3,3*a*) with a vertical steering type axle (K);

a smoothing device being attached to the rear section (2,2*a*) of the vehicle frame, wherein the smoothing device is pivotable around a vertical pivot axis, located in the rear section of the vehicle, longitudinally spaced from the vertical steering type axle;

the vehicle further including a smoothing device in a rear section, wherein the smoothing device (12) pivots between an operating position lowered to the ground and a resting position; and a rear wheel steering mechanism, wherein the smoothing device is linked to the rear wheel steering mechanism in such a way that during a steering movement of the rear wheel steering mechanism, the smoothing device is automatically, especially mechanically or hydraulically, pulled behind, the smoothing device being connected by a coupling device (T), for pivoting about a pivot axis S which perpendicularly intersects a line connecting the pivot axes of the rear wheels, coupling device (T) being operably configured so that the smoothing device is not permitted to pivot freely during a steering movement of the rear wheel steering mechanism, but is constrained to be steered at a specified angle, which is dependent upon the steering of the rear wheel steering mechanism.

2. The vehicle according to claim 1, further including a main drive, wherein the control of the smoothing device is dependent on vehicle directional steering of the main drive such that the smoothing device is tilted upward during reverse motion of the machine.

3. The vehicle according to claim 1, wherein the smoothing device is designed as a rotating roller, which is provided with a surface contour that presses a defined pattern into the ground.

4. The vehicle according to claim 1, further including a collection container (1) for collected material, wherein a floor section of the collection container runs on moveable bearings between a closed operating position and an emptying position that exposes the interior of the container.

5. The vehicle according to claim 1, wherein at least one horizontal loading surface featuring an at least partially removable floor is assigned to the rear section (2*a*).

6. The vehicle according to claim 5, wherein the loading surface is laterally secured with at least one support railing (31), which runs on bearings between a locking position and a loading position.

7. The vehicle according to claim 1, wherein the smoothing device is pivotable around a horizontal pivot axis.

8. The vehicle according to claim 1, wherein a rear wheel steering mechanism is assigned to the rear wheels (5*a*) of the rear wheel axle (5).

9. The vehicle according to claim 8, wherein the smoothing device is linked to the rear wheel steering mechanism in such a way, that during a steering movement of the rear wheel steering mechanism, the smoothing device is automatically, especially mechanically or hydraulically, pulled behind.

10. The vehicle according to claim 8, wherein a vertical pivot axis bisects the rear wheel axle of the rear wheel steering mechanism.

11. The vehicle according to claim 8, wherein the smoothing device pivots around the vertical pivot axis with an angle γ approximately corresponding to a steering angle of an outer and/or inner wheel.

12. The vehicle according to claim 11, further including a driving mechanism, wherein an internal combustion engine (8) of the driving mechanism is arranged, as the main drive, in the front section (1,1*a*) of the vehicle frame, and a power takeoff is arranged, as a supplementary drive, in the front of the vehicle and is derived from the internal combustion engine (8).

13. The vehicle according to claim 11, wherein a hydraulic drive derived from a main hydraulic drive is provided as the supplementary drive.

14. The vehicle according to claim 1, wherein a front wheel steering mechanism is assigned to the front wheels (4*a*) of the front wheel axle (4).

15. A vehicle for beach cleaning, comprising:

a front section (1,1*a*) of a vehicle frame, including a front wheel axle, a rear section (2,2*a*) of a vehicle frame, including a rear wheel axle, and a rear wheel steering mechanism, said front section and said rear section being connected to one another by an articulated bearing (3,3*a*) with a vertical steering type axle (K);

a smoothing device being attached to the rear section (2,2*a*) of the vehicle frame, wherein the smoothing device is pivotable around a vertical pivot axis, located in the rear section of the vehicle, longitudinally spaced from the vertical steering type axle, the smoothing device being connected by a coupling device (T), for pivoting about a pivot axis S which perpendicularly intersects a line connecting the pivot axes of the rear wheels, coupling device (11*a*) being operably configured so that the smoothing device is not permitted to pivot freely during a steering movement of the rear wheel steering mechanism, but is constrained to be steered at a specified angle, which is dependent upon the steering of the rear wheel steering mechanism;

the vehicle including a collection container for collected material, wherein the collection container (11*a*) is mounted onto the rear section on pivoting or tilting wherein the rear section (2*a*) features a horizontally spatially displaceable auxiliary frame (32) to which the collection container (11*a*) is linked, and which is especially provided with a platform;

wherein parallel articulated mechanisms (35,36) are provided for spatial displacement of the auxiliary frame (32), which are actively connected to an automatic guiding mechanism (37) linked to the collection container (11), 50 that the collection container (11*a*) is automatically brought into its emptying position when the auxiliary frame (32) is moved upward and backward (relative to the normal direction of travel), and the collection container (11*a*) is automatically brought into a collection position when the auxiliary frame (32) is moved into its lowered position.

16. The vehicle according to claim 15, wherein at least one driving mechanism (33) is provided for spatial displacement of the auxiliary frame (32).

17. A vehicle for beach cleaning comprising:

a front section (1,1*a*) of a vehicle frame, including a front wheel axle, a rear section (2,2*a*) of a vehicle frame, including a rear wheel axle, said front section and said rear section being connected to one another by an articulated bearing (3,3*a*) with a vertical steering type axle (K);

a smoothing device being attached to the rear section (2,2*a*) of the vehicle frame, wherein the smoothing device is pivotable around a vertical pivot axis, located in the rear section of the vehicle, longitudinally spaced from the vertical steering type axle; and further including a cleaning device for loose ground, especially sand, arranged on a support frame, which features a receiving area mounted on pivoting bearings between a receiving position lowered toward the ground and a resting position pivoted upward, wherein the cleaning device features a filter device with a circumferential filter belt, wherein a carrying run (19) of the filter belt (19,20) is mounted on vibrating rollers running on eccentric bearings, which rollers are offset against one another.

18. The vehicle according to claim 17, wherein an independently driven supplementary propulsion mechanism (22) is assigned to the carrying run (19) of the filter belt, which operates together with the carrying run (19) in synchronization with the belt speed of the filter belt.

19. The vehicle according to claim 17, wherein a feed roller (23) provided with receiving elements is assigned to the receiving area (21), which roller can be moved in various directions by means of a swivel arm apparatus (25) connected to the support frame (16,18) and with the aid of adjustment tools with overlapping pivoting motions.

20. The vehicle according to claim 17, wherein protective panels (30) mounted on moveable bearings on the rear section (2*a*) are arranged on both sides of the cleaning device (6*a*).

21. A vehicle for beach cleaning comprising:

a front section (1,1*a*) of a vehicle frame, including a front wheel axle, a rear section (2,2*a*) of a vehicle frame, including a rear wheel axle, said front section and said rear section being connected to one another by an articulated bearing (3,3*a*) with a vertical steering type axle (K);

a smoothing device being attached to the rear section (2,2*a*) of the vehicle frame, wherein the smoothing device is pivotable around a vertical pivot axis, located in the rear section of the vehicle, longitudinally spaced from the vertical steering type axle; and further including a cleaning device for loose ground, especially sand, arranged on a support frame, which features a receiving area mounted on pivoting bearings between a receiving position lowered toward the ground and a resting position pivoted upward, wherein the cleaning device features a filter device with a circumferential filter belt, wherein the filter belt is assigned at least one vibration shaft (38) on which at least one vibration element (39) is arranged coaxially and which, is connected to the filter belt and which—when seen in cross-section, is provided with greater longitudinal than lateral extension.

22. The vehicle according to claim 21, wherein an outside perimeter of the vibration element (39) is provided with a circumferential toothed contour (43).

* * * * *